US006796088B2

(12) United States Patent
Richmond et al.

(10) Patent No.: US 6,796,088 B2
(45) Date of Patent: Sep. 28, 2004

(54) FIREPLACE INSTALLATION ASSEMBLY AND METHOD

(75) Inventors: David Bruce Richmond, Portland, OR (US); Edwin Glen Yoder, Estacada, OR (US); Jeffrey Lee Yoder, Gresham, OR (US)

(73) Assignee: Yoder Stove and Supply, Inc., Sandy, OR (US)

( * ) Notice: Subject to any disclaimer, the term of this patent is extended or adjusted under 35 U.S.C. 154(b) by 0 days.

(21) Appl. No.: 10/191,649

(22) Filed: Jul. 8, 2002

(65) Prior Publication Data

US 2003/0140570 A1 Jul. 31, 2003

Related U.S. Application Data

(60) Provisional application No. 60/353,747, filed on Jan. 29, 2002.

(51) Int. Cl.[7] ..... F24B 1/198; F24B 1/18

(52) U.S. Cl. ..... 52/36.3; 126/500

(58) Field of Search ..... 52/210, 211, 36.3; 126/500, 553, 546, 515; D25/119, 99, 120, 123, 125; D23/314, 343, 344, 345, 346, 347, 348, 349, 350

(56) References Cited

U.S. PATENT DOCUMENTS

| | | | | | |
|---|---|---|---|---|---|
| 158,472 | A | | 1/1875 | Creamer | |
| 245,095 | A | | 8/1881 | Scantlin | |
| 254,868 | A | | 3/1882 | Gudgeon | |
| 269,536 | A | * | 12/1882 | Page | 52/36.3 |
| 420,775 | A | | 2/1890 | Dambach | |
| 451,877 | A | * | 5/1891 | Arbrgust | 49/459 |
| 482,333 | A | * | 9/1892 | Benbow | 52/36.3 |
| 523,037 | A | | 7/1894 | Hewitt | |
| 661,500 | A | | 11/1900 | Darnes | |
| 827,369 | A | | 7/1906 | Holbein et al. | |
| 856,060 | A | * | 6/1907 | Hepburn | 446/480 |
| 1,573,864 | A | * | 2/1926 | Reuter-Lorenzen | 126/500 |
| RE17,552 | E | * | 1/1930 | Andersen | 52/204.1 |
| 2,362,526 | A | | 11/1944 | Austin | |
| 2,741,345 | A | * | 4/1956 | Herr | 52/211 |
| 3,224,429 | A | | 12/1965 | Quittner | |
| 3,436,886 | A | * | 4/1969 | Nowak et al. | 52/208 |
| 3,690,076 | A | * | 9/1972 | Harris, Jr. | 52/36.3 |
| 4,254,596 | A | * | 3/1981 | Wright et al. | 52/36.3 |
| 4,303,056 | A | | 12/1981 | Slavik et al. | |
| 4,700,687 | A | * | 10/1987 | Bailey et al. | 126/500 |
| 4,727,698 | A | * | 3/1988 | Altman | 52/314 |
| 5,119,603 | A | * | 6/1992 | Jones | 52/36.3 |
| 5,139,011 | A | | 8/1992 | Moon | |
| 5,572,986 | A | | 11/1996 | Eberhardt | |
| 5,737,888 | A | | 4/1998 | Shimek et al. | |
| 5,934,268 | A | | 8/1999 | Onocki | |
| 6,029,731 | A | | 2/2000 | Brazell | |
| 6,643,988 | B1 | * | 11/2003 | Armstrong et al. | 52/656.2 |
| 2003/0140570 | A1 | * | 7/2003 | Richmond et al. | 52/36.3 |

OTHER PUBLICATIONS

"Regency Fireplace Products", brochure, dated Jul. 2000.
"Choose Fireplace Xtrordinair™", brochure, published more than one year prior to filing date.
"Hearth Pads", brochure, published more than one year prior to filing date.
"Hearth Classics™ by Yoder's", brochure, published more than one year prior to filing date.
"Regency Fireplace Products", specification, dated Oct. 4, 2001.

* cited by examiner

*Primary Examiner*—Carl D. Friedman
*Assistant Examiner*—Kevin McDermott
(74) *Attorney, Agent, or Firm*—Klarquist Sparkman LLP

(57) ABSTRACT

A fireplace assembly is comprised of a fireplace surround having surround leg portions which may be inserted into a base to adjust the elevation of the fireplace surround. The base may include one or more elongated slots or other openings for receiving lower end portions of the surround leg portions. These surround leg portions may be slidably coupled or otherwise movable relative to a surround breast portion to facilitate width adjustment of the spacing between the surround leg portions. A mantel assembly may also be included.

36 Claims, 9 Drawing Sheets

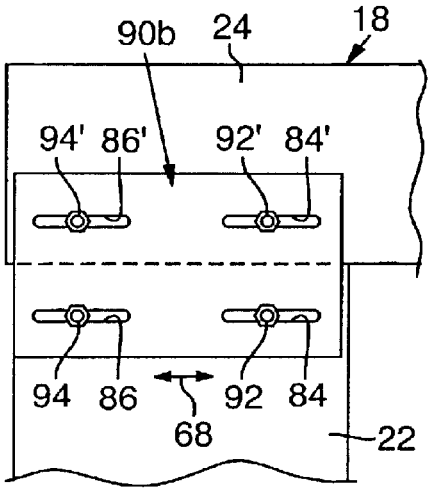
FIG. 10a
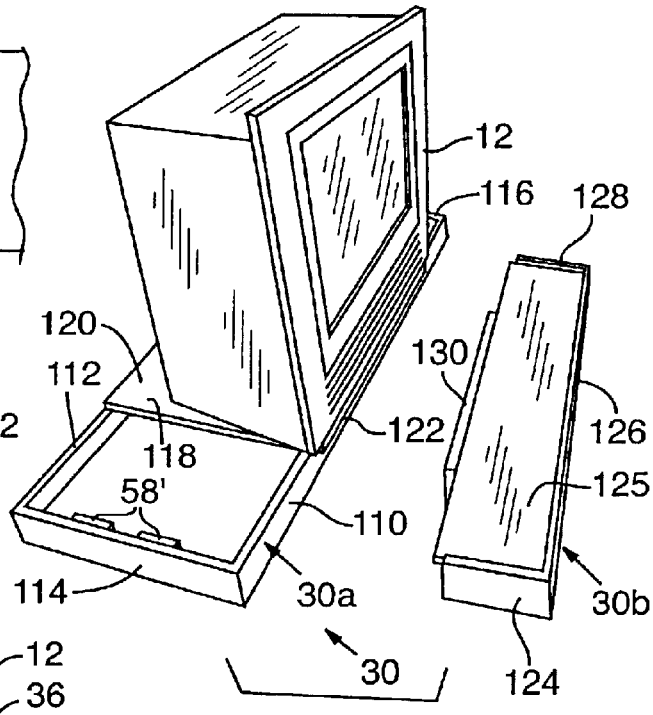
FIG. 11
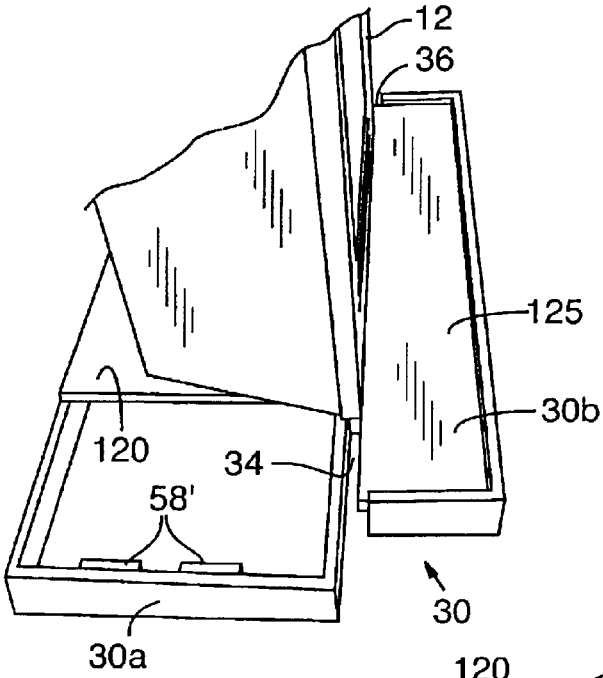
FIG. 12
FIG. 12a
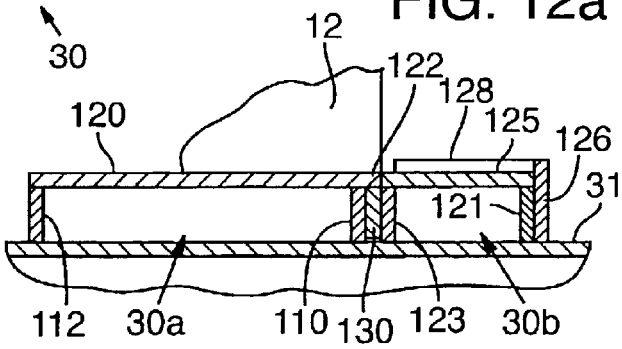

FIREPLACE INSTALLATION ASSEMBLY AND METHOD

RELATED APPLICATION DATA

This application claims priority to Provisional U.S. patent application Ser. No. 60/353,747, filed Jan. 29, 2002, entitled, "FIREPLACE INSTALLATION ASSEMBLY AND METHOD", by David Bruce Richmond, Edwin Glen Yoder, and Jeffrey Lee Yoder, which is hereby incorporated by reference.

BACKGROUND

The disclosure relates to improved fireplace surrounds with or without a mantel assembly and to methods of installation to provide a fireplace assembly.

It is desirable in many homes and other locations to install a fireplace for heating purposes and for desirable visual aesthetic effect. It is common for fireplaces, such as gas fuel fireplaces, to be provided as self-contained units for installation in extremely close proximity to combustible materials. These fireplaces typically have a door for enclosing a fireplace opening with the door often being transparent so that the burning flame can be seen by occupants of the location where the fireplace is being operated.

It is common to provide a decorative fireplace surround along the boundaries of the fireplace. The fireplace may have a projecting flange adjacent to a fireplace opening against which the surround abuts when installed. Typically, the surround is of a non-combustible material such as a cementous backer board overlaid with brick or tile facing for a visually pleasing effect. A hearth may be installed beneath the fireplace opening and may extend into the room. The hearth may be a raised hearth or inset into the flooring. The fireplace may also be recessed into a wall of a room or may project outwardly into the room.

A typical surround has first and second surround leg portions and a surround breast plate portion, which may be straight or curved, extending between the surround leg portions. The surround breast plate portion is commonly co-extensive in width with the outer edges of the surround leg portions and is mounted to the surround leg portions. A combined single piece surround having leg and breast plate portions may be provided. In addition, the surround may have a lower cross-piece portion for positioning beneath the fireplace opening in the event the fireplace is raised off of the floor.

In a common installation approach, an inventory of multiple fireplace surrounds is provided with surround legs being spaced at various distances apart in the different models of surrounds to accommodate fireplace openings of different widths. This can require a substantial inventory of fireplace surrounds. In addition, to adjust the height of a fireplace surround, it is common practice to saw or otherwise cut enough from the bottom of the surround legs, for example using a rotary saw with a masonry blade, to thereby establish the height of the surround breast portion at a desired elevation. Once the surround and hearth have been installed, a mantel is typically assembled in place.

A need exists for an improved fireplace assembly and method.

The present invention relates to new and unobvious features and method acts and steps as set forth herein, both alone and in various combinations and sub-combinations with one another. The invention is not limited to an apparatus and/or method requiring all the elements and method acts set forth herein or any specific combinations or sub-combinations thereof. The invention is defined by the claims below.

SUMMARY

In accordance with one aspect of an embodiment, a fireplace installation assembly comprises a base which defines at least one surround receiving opening extending below an upper surface of the base. A fireplace surround comprises first and second surround leg portions and a surround top portion. The surround leg and top portions may be of unitary, monolithic, one-piece construction. However, desirably the surround leg portions are moveable relative to the top portion to adjust the spacing between the leg portions to accommodate fireplace openings of different widths. The surround leg portions may be slidably coupled to the surround top portion to facilitate this width adjustment.

The surround leg portions may have lower end portions which are inserted into the at least one opening of the base with the extent of insertion of the first and second surround leg portions into the opening adjusting the height of the fireplace surround.

In according with another aspect of an embodiment, the base may be of a plural piece construction with a portion of the surround opening defined by a first section of the base and a portion of the surround opening defined by a second section of the base.

The at least one surround opening may comprise plural surround openings such as first and second elongated slots, one being positioned to receive a lower end portion of a first surround leg and the other being positioned to receive a lower end portion of a second surround leg. If a surround has in excess of two lower leg end portions, the first and second openings may be supplemented by additional openings to receive any such additional lower leg end portions.

The surround receiving opening may be elongated and extend parallel to the front edge portion of the base. Alternatively, the fireplace may have a front and the base may have a width dimension which extends in a direction which is parallel to the fireplace front. The opening may comprise first and second elongated slots which extend lengthwise in the width direction.

In accordance with another aspect of an embodiment, the fireplace may be of the type which has a fireplace projection which extends outwardly from at least a top portion of the fireplace. The fireplace projection may alternatively comprise a flange which extends continuously around the boundary of a fireplace opening or only along portions of the boundary. In an embodiment where the fireplace has a projection extending outwardly from at least an upper portion of the fireplace, the top surround portion may comprise an insertion limiter which is adapted for coupling to the fireplace projection to limit the downward insertion of the lower surround leg end portions into the base. The insertion limiter may take any convenient form and may simply comprise a lower edge portion of the top surround portion which is positioned for coupling to or engagement with the top fireplace projection. The fireplace projection may also comprise respective projection portions positioned for coupling to the respective surround leg portions. The surround may also comprise a lower surround portion which extends, for example, beneath the fireplace opening and between the first and second surround leg portions in the event the fireplace is raised, for example, relative to the base.

As another aspect of an embodiment, the first and second surround leg portions may each comprise an outer surround leg upright edge portion and an inner surround leg upright edge portion. The respective inner surround leg upright edge portions may be positioned along the respective sides of the fireplace opening. Also, the top surround portion may comprise an upper top surround edge portion and a lower top surround edge portion. The lower top surround edge portion may be positioned adjacent to at least a portion of the top of the fireplace opening. A mantel assembly may also be provided.

A mantel assembly, if present, may comprise a first mantel side portion for coupling to the first surround leg portion; a second mantel side portion for coupling to the second surround leg portion; and a mantel breast portion for coupling the first and second mantel side portions together. The mantel breast portion comprises a lower mantel breast edge portion which may be positioned to cover a portion of the upper top surround edge portion. The mantel assembly may also comprise a mantel shelf coupled to the first and second mantel side portions and to the mantel breast portion. Other mantel components may be used in alternative mantel constructions.

As a specific aspect of an embodiment, in one form the mantel side portions may each define respective channels or slots. The outer surround leg upright edge portion of the first surround leg may be positioned at least partially in the slot or channel of the first mantel side portion. In addition, the outer surround leg upright edge portion of the second surround leg portion may be positioned at least partially in a channel or slot defined by the second mantel side portion.

The components of a fireplace assembly in accordance with these embodiments may be installed in various orders. Desirably, the base is placed onto a floor of a room. The fireplace is positioned onto an upper surface of the base. The space between the first and second surround leg portions of a fireplace surround is adjusted to position the respective leg portions adjacent to the respective sides of a fireplace or fireplace opening. The lower end portions of the respective first and second surround leg portions are positioned below the upper surface of the base to thereby position a lower edge portion of a surround top piece at a desired elevation relative to the floor of the room. The elevation of the top surround portion in this embodiment is determined by the extent to which the lower end portions of the respective first and second surround leg portions are positioned below the upper base surface.

The installation may be accomplished in the order set forth in the preceding paragraph. Alternatively, other installation sequences may be used. For example, the spacing between the surround leg portions may be adjusted prior to or following the positioning of the lower end portions below the upper surface of the base. The act of positioning the lower end portions desirably comprises inserting the lower end portions into at least one opening defined by the base.

A mantel may also be assembled and desirably is assembled after the fireplace surround is in position. Alternatively, the mantel may be provided with recesses, channels or slots to permit the installation of the surround, for example insertion of the surround from above, following the positioning of mantel sides and a mantel breast portion.

The invention is not limited by the specific embodiments described herein. The invention again is directed toward new and unobvious elements, features, method acts and steps alone and in various combinations and sub-combinations thereof as set forth in the claims below.

BRIEF DESCRIPTION OF THE DRAWINGS

FIG. 10*a* illustrates yet another form of coupling bracket.

FIG. 11 is a perspective view of an alternative form of base comprised of plural base sections.

FIG. 12 is a perspective view of the embodiment of FIG. 11 and showing the base sections in an assembled position.

FIG. 12*a* illustrates a vertical section view through a portion of the assembled base sections of FIG. 12.

DETAILED DESCRIPTION

Figure 1:
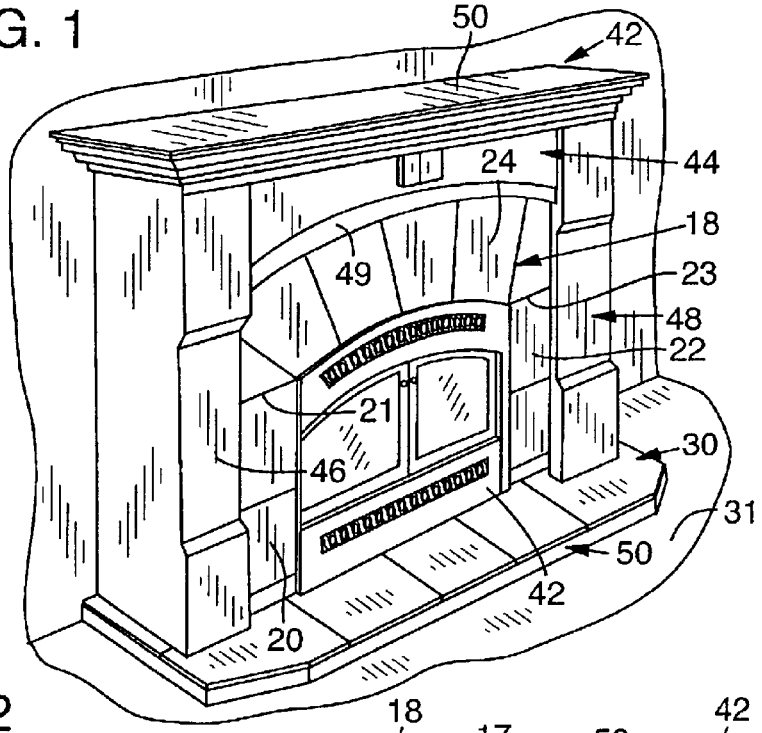
FIG. 1 is a perspective view of one embodiment of a fireplace assembly.
Figure 2:
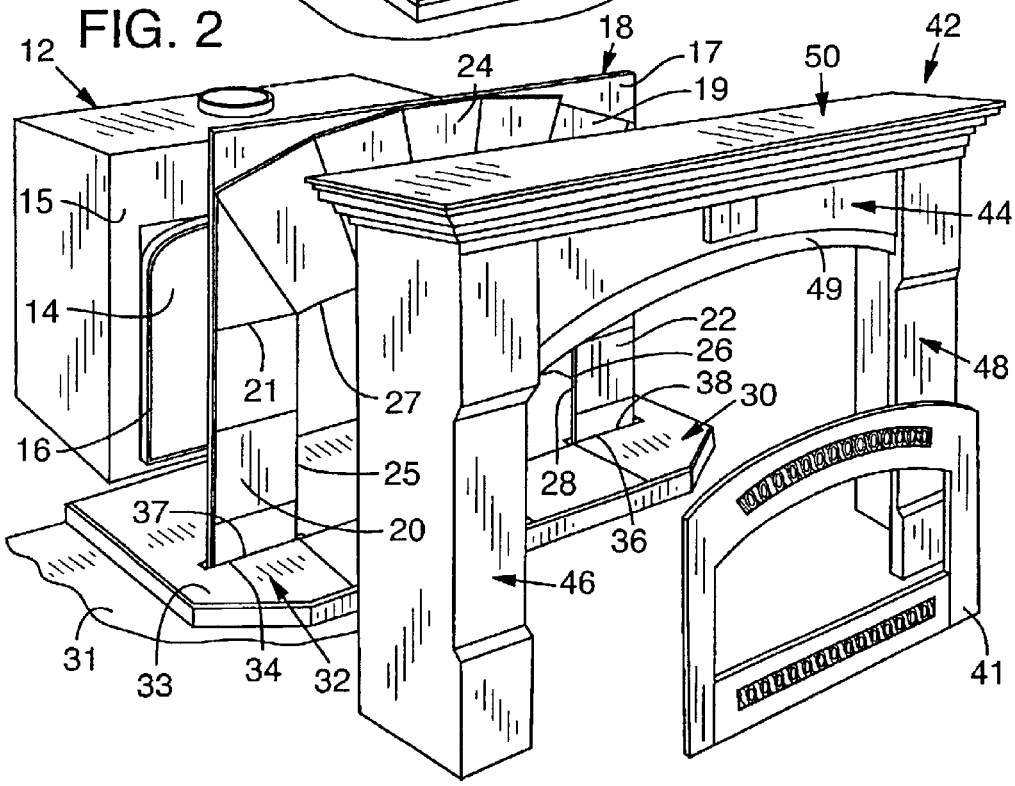
FIG. 2 is a partially exploded perspective view of the embodiment of FIG. 1.

With reference to FIGS. 1 and 2, an exemplary fireplace 12 is illustrated. Fireplace 12 may be a self-contained unit and may be fueled by any suitable fuel source such as natural gas or other combustible material. The fireplace 12 comprises a fireplace opening 14 which in the illustrated embodiment has a curved top portion, first and second side portions and a bottom portion. The fireplace may include a projection which extends forwardly from the front 15 of the fireplace. The projection may extend along a portion of the fireplace top and may include projections along the respective sides and bottom of the fireplace opening. Although the projections may take any suitable form, in one illustrated form the projections comprise a continuous projecting flange 16 extending around the entire boundary of the fireplace opening.

One form of a fireplace surround is indicated in FIGS. 1 and 2 and designated by the number 18. A fireplace surround may be generally planar and may be of a laminated structure. For example, a surround may be formed of a layer of cementous board 17 to which tile, brick or other decorative facing material is cemented or otherwise secured. Grout may also be used between tiles or other facing material components for added decorative effect. Fireplace surrounds may assume other configurations. The illustrated surround 18 may be of a single piece unitary monolithic construction.

However, desirably the surround comprises first and second leg portions 20,22 and a surround breast portion 24 which extends from one leg portion to the other leg portion. A seam or joint, such as indicated at 21, may exist between the first surround leg portion 20 and the surround breast portion 24. Similarly, a joint or seam 23 may exist between the second surround leg portion 22 and the surround breast portion 24. The components 20,24 and 22, 24 may be interconnected in any convenient manner, such as explained in greater detail below.

Inner upright side edges 25,26 of the respective surround leg portions 20,22, together with a lower edge portion 27 of the surround breast portion 24, together define a surround opening indicated generally at 28.

Although not necessary, for aesthetic reasons when the FIG. 1 form of fireplace assembly is complete, desirably an upright inner edge 25 of surround leg portion 20 is positioned adjacent to the portion of flange 16 along a first side of the fireplace opening. In addition, an upright inner edge 26 of surround leg portion 22 is positioned adjacent to the portion of the flange 16 along the opposite side of the fireplace opening. In addition, the lower edge portion 27 of the mantel breast portion 24 may be positioned to engage or be otherwise coupled to at least a portion of a top projection, such as a portion of flange 16 along the top of the fireplace opening. In general, the top projection, when included, comprises a stop or other mechanism for limiting the downward positioning of the fireplace surround.

As can be seen in FIG. 2, the assembly in one embodiment desirably comprises a base, with one form of base being indicated generally at 30. During installation, the base 30 is typically placed on the upper surface of a floor 31 of the room or other building. The base 30 has an upper surface 32 which is spaced above the floor 31. The base 30 may comprise tile or other decorative surface covering materials, such as indicated at 33 in FIG. 2. As can be seen in FIG. 2, the illustrated base 30 defines at least one opening, in this case two such openings 34,36 which comprise elongated spaced apart slots in this example. The openings 34,36 are positioned respectively to receive a lower end portion 37 of the surround leg portion 20 and a lower end portion 38 of the surround leg portion 22. In this embodiment, the depth of insertion of the lower end portions 37,38 establish the height of the surround. Typically, the surround 18 is inserted until such time as the insertion limiter, such as a portion of flange 16 or of the fireplace engages a portion of the surround breast piece to limit further downward motion of the surround and establish the height of the surround. A fireplace door or screen 41 may also be included in the fireplace to cover the fireplace opening.

The fireplace assembly may also comprise an optional mantel assembly such as indicated generally at 42. This illustrated mantel assembly embodiment has a front mantel breast plate portion 44 and respective mantel side portions 46,48. The mantel breast plate portion 44 couples the mantel side portions 46,48 together. A mantel shelf portion 50 may be coupled to the upper end portions of the mantel sides 46,48 and the upper edge of the mantel breast portion 44. The mantel breast portion may also comprise a lower edge portion 49 which desirably overlays or abuts a portion of the upper edge margin of the fireplace surround.

The base 30 may take numerous forms. In the form illustrated in FIG. 3, the base 30 is generally of a rectangular-box-like construction and may be made of wood or any other suitable material. In this example, trim pieces, such as about four inches in height, although the height may be varied, are positioned along the sides and front of the base. Supporting joists, some of which are indicated at 52, may be positioned to provide support to an upper member, such as platform 53, of the base. An optional cross piece 55, at the rear of the base, may also be provided. The tile or other decorative surface material 33 may be placed on the upper surface of member 53. The trim pieces typically extend upwardly above the surface 53 a distance which approximates the thickness of tile or other decorative material which is to be placed on the surface 53. Fastener receiving pieces, which may comprise brackets or braces and which may simply be wood strips, may be mounted to the upper surface 53 at a location spaced inwardly from the respective sides of the base. Members 56,58, which may comprise wood nailing strips are exemplary fastener receiving members. Lower edge portions of the respective mantel sides 46,48 may be fastened to members 56,58 when the assembly is completed. Other mechanisms for connecting mantel sides to the base may of course be used.

Figure 3:
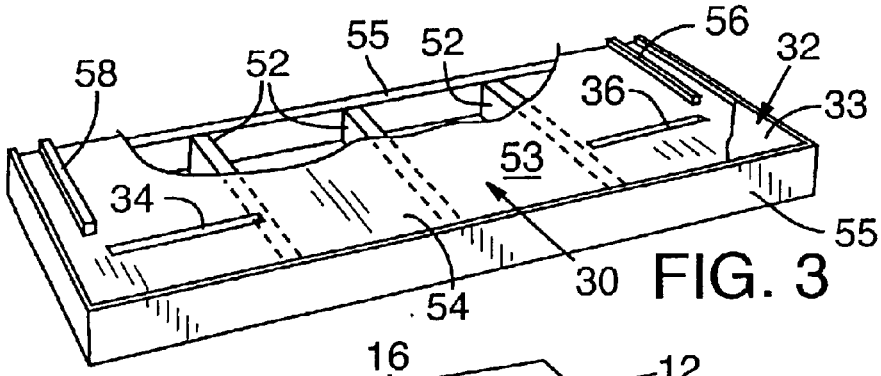
FIG. 3 is a partially broken away perspective view of one form of a base usable in the embodiment of FIG. 1.
Figure 5:
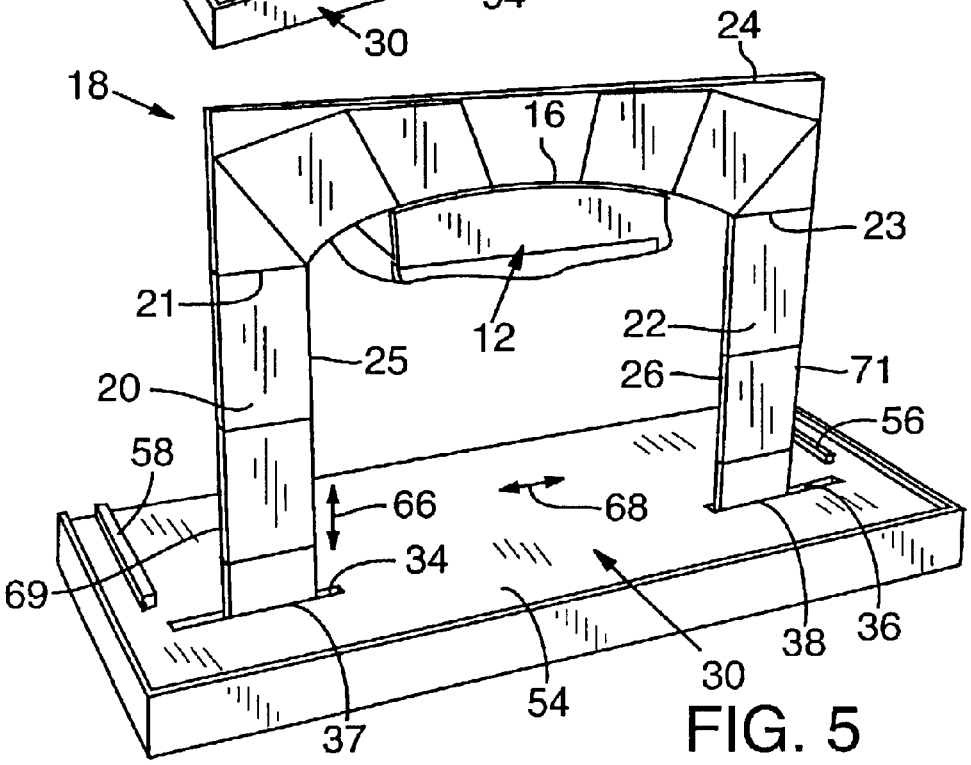
FIG. 5 is a view of the embodiment of FIG. 4 with an exemplary fireplace surround shown in position relative to the base of FIG. 4.

Although the front 55 of base 30 may be curved or otherwise configured for aesthetic reasons, in the illustrated FIG. 3 embodiment the front 55 is straight. In this embodiment, the respective openings 34,36 are elongated and extend in a direction parallel to the base front 55. Although less desirable, instead of spaced apart openings 34,36, a single opening may be used to receive the lower surround leg portions. In this case, portions of the opening which are not occupied by the surround leg portions may be filled or covered, such as by the tile or other decorative material. It is more desirable to use spaced apart openings as these would tend to weaken the base to a lesser extent. Also, since the surround leg portions are typically spaced apart from one another a sufficient distance to accommodate the fireplace opening, in the illustrated embodiment the provision of a continuous elongated opening is not necessary. As can be seen in FIG. 3, the joists 52 are typically positioned to avoid the area beneath the openings 34,36. Consequently, the lower end portions 37,38 of the surround legs 20,22 may be inserted into the respective slots 34,36 unimpeded by the joists. As can be seen in FIG. 5, this construction allows movement of the surround 18 upwardly and downwardly as indicated by arrow 66. As a result, the height of the surround can be adjusted to match the desired elevation of the surround within limits by simply raising and lowering the surround a desired extent with the leg portions 37,38 inserted a lesser or greater extent into the respective openings 34,36. As also can be seen in FIG. 5, the slots 34,36 may extend generally in a direction which corresponds to the width dimension of the base 30. In addition, these slots may be oversized, for example in a lengthwise dimension, to accommodate surround legs of a variety of widths. As a specific example, these slots may be about one inch wide and may be eight to twelve inches long. The width of the slots is desirably wider than the thickness of the portion of the fireplace surround legs which is inserted into the slots. Openings of other configurations may be utilized to accommodate the insertion of surround legs of various shapes. Additional openings may be provided in the event the surround has more than two lower leg end portions.

In addition, in desirable embodiments as explained in greater detail below, the surround leg portions 20,22 may be movable relative to the surround breast portion 24, for example along respective joints 21,23. As a result, the spacing between inner edges 25,26 of the surround leg portions may be varied, for example to match the width of the fireplace or fireplace opening with which the surround 18 is being used. Once the spacing of the surround legs is established, the surround legs may be fixed to the surround breast portion 24. Alternatively, and as explained in greater detail below, surround leg portions 20,22 may be slidably coupled to surround breast portion 24 to facilitate adjustment of the spacing between the surround legs. Following adjustment, fasteners or other coupling elements may be tightened to restrict further relative motion of surround leg portions 20,22 with respect to surround breast portion 24.

The slots 34,36 are desirably sized to accommodate the surround leg position spacing adjustment.

Figure 4:
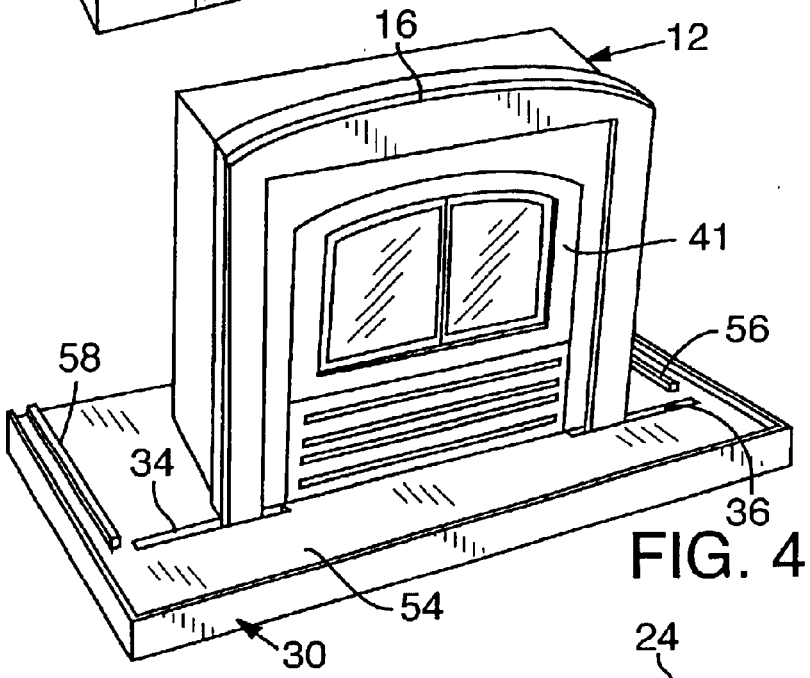
FIG. 4 is a perspective view illustrating a fireplace positioned on the base.

FIG. 4 illustrates a fireplace 12 in position on the upper surface 54 of the base 30 and shows an exemplary location of the slots 34,36 relative to the fireplace. For a flush mounted fireplace, that is one which is to be mounted into the wall of a room or other structure, portions of the base 30 rearwardly of the slots may be removed to allow the remaining center portion of the base to be inserted into a built-in recessed area of a house or other structure. In this case, a portion of the boundary of the slot or opening may be defined by the base with remaining portions being defined by, for example, the wall of the structure against which the fireplace surround is mounted in this flush-mount application.

As best seen in FIG. 5, arrow 68 indicates the directions in which the surround leg portions 20,22 are moved in the illustrated embodiment to adjust the spacing between inner edges 25 and 26. Surround leg portion 20 also comprises an upright outer edge portion 69 opposite to edge portion 25 in this example. In addition, surround leg portion 22 comprises an upright outer edge portion 71 which is, in this example, opposite to edge portion 26.

Figure 6:
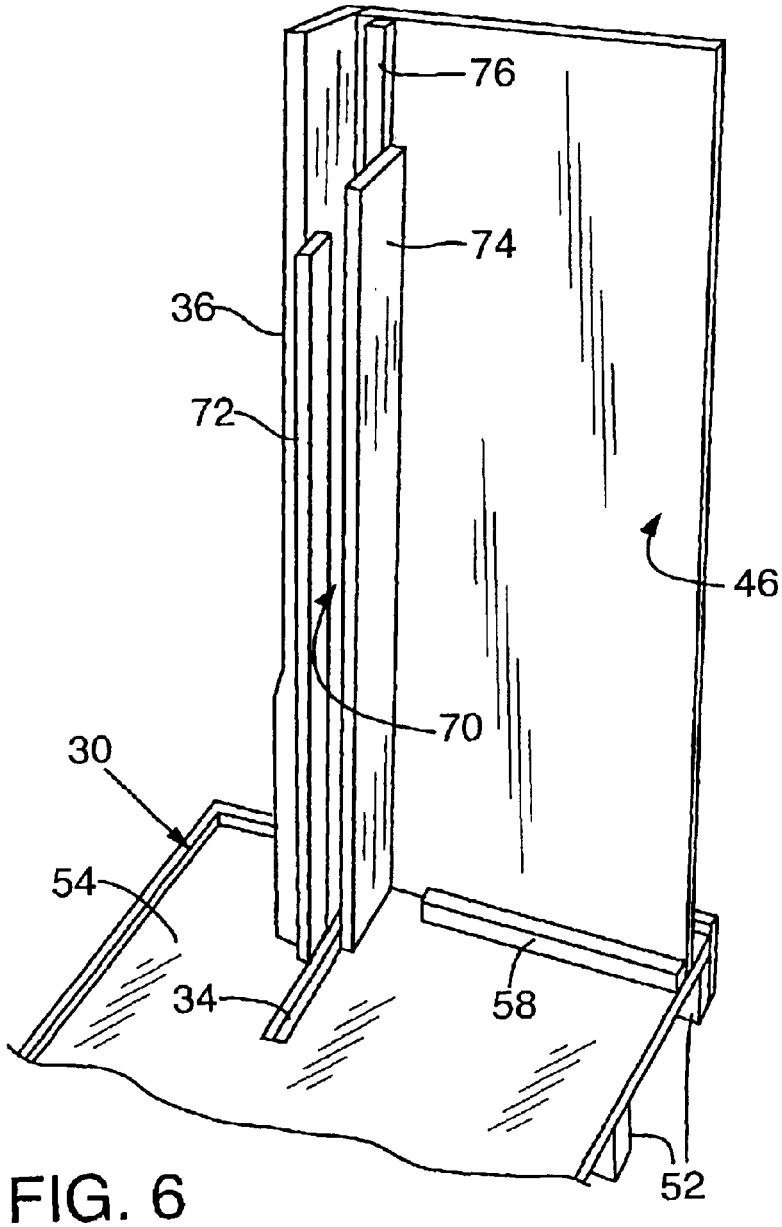
FIG. 6 is a perspective view of one form of a mantel side having a slot for receiving a portion of an outer edge of a surround leg portion.

The mantel assembly may take numerous forms. One specific example of a mantel side 46 is shown in FIG. 6. In this example, the surround has been removed for purposes of explanation.

Figure 7:
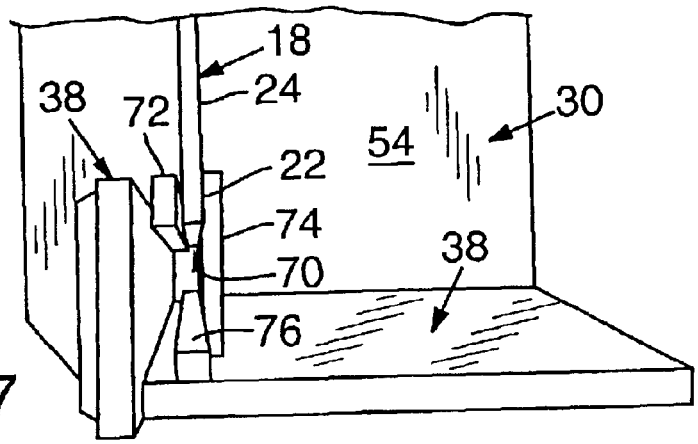
FIG. 7 illustrates a top view of a fireplace installation assembly with a portion of a surround leg portion shown positioned in a slot of a mantel side.

In FIG. 6, the mantel sides, in this case the mantel side 46, is constructed to define an upright slot or channel between a front portion 72 of the mantel side 46 and a spacer 74. A filler strip 76 may be included to provide a surface to which the spacer 74 may be attached. The height of members 72,74 may be adjusted and such members may extend the full height of the mantel side. However, typically member 72 would stop below the upper edge of the mantel surround and, in such a case, may provide a rest for supporting the mantel breast portion following its installation. When the fireplace assembly is completed, the outer edge margin 69 of surround leg 20 is positioned within slot 70 of mantel side 46. The mantel side 48 may be similarly constructed so as to define a slot for receiving the outer edge margin 71 of mantel surround leg portion 22. FIG. 7 illustrates the positioning of mantel side 48 with slot 70 receiving the outer side edge margin of surround leg 22. The slot or channel 70 may alternatively be defined by pegs or other spaced apart elements. In addition, slots 70 are desirable, but not necessary.

Figure 8:
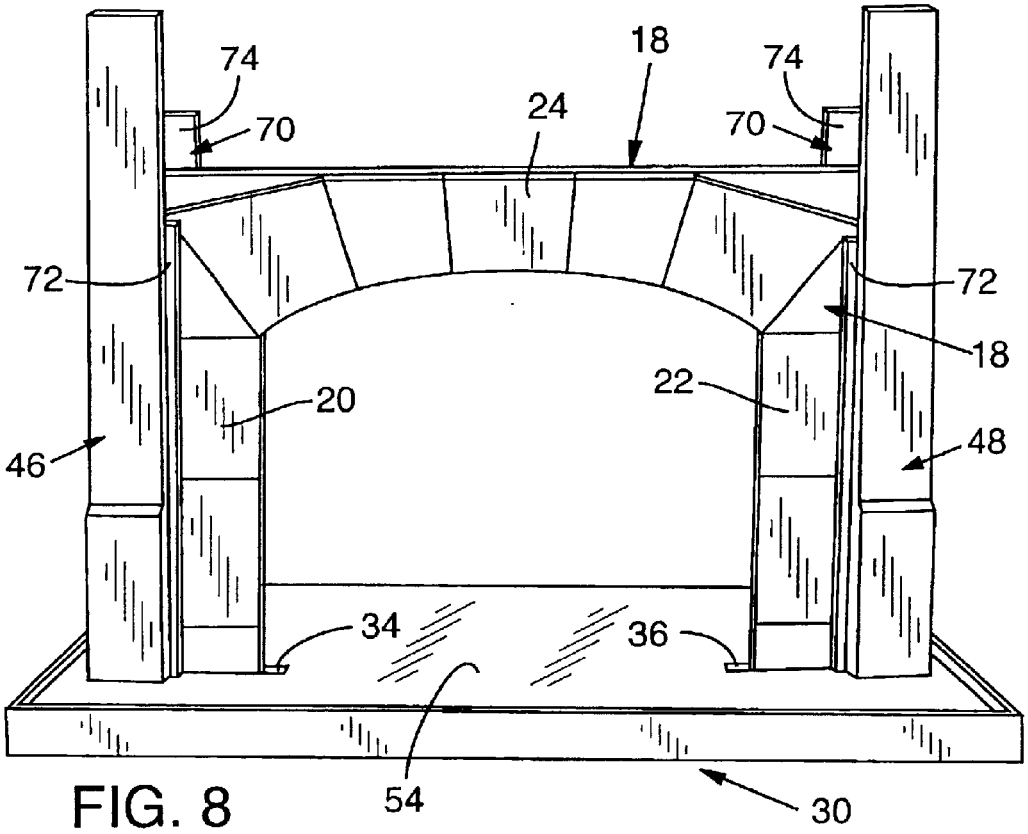
FIG. 8 illustrates a fireplace assembly in accordance with one embodiment with a fireplace surround in position (the fireplace having been deleted from this illustration) and with first and second mantel sides in position.

FIG. 8 illustrates the exemplary mantel surround with surround leg portions 20,22 inserted into the respective slots 70 of the mantel sides 46,48. In FIG. 8, the fireplace has been removed for clarification in illustrating this particular embodiment.

As mentioned above, the fireplace surround may be of a plural piece construction. For example, the surround may have separate leg and top portions 20,22 and 24.

Figure 9:
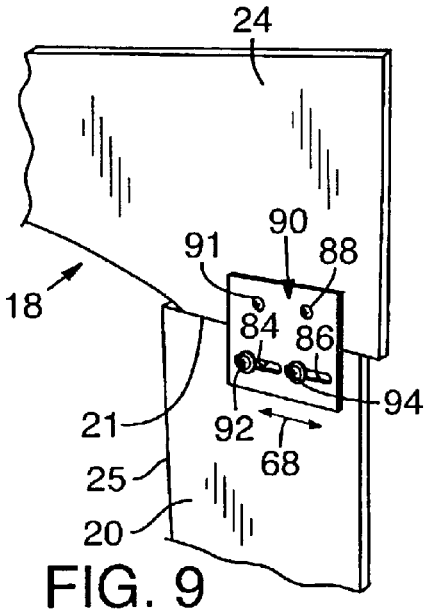
FIG. 9 illustrates an embodiment of the surround in which the surround top portion and surround leg portions are comprised of separate pieces which are slidably coupled together with a form of coupling bracket as shown in FIG. 9.

FIG. 9 illustrates one approach for coupling the surround leg portions to the surround breast portion to allow relative sliding movement of these members to accommodate variations in spacing between the inner edges of the respective surround leg portions. As a specific example, the surround leg portions may be slidably coupled to the surround breast portion. Various mechanisms for accomplishing this sliding coupling may be used, such as interfitting slide elements. As a mechanically simple construction, a bracket may be used for this purpose with one form of such a bracket being indicated at 90 in FIG. 9. The illustrated bracket 90 has elongated openings 84,86. These openings extend lengthwise in this example in the direction 68 corresponding to the directions the inner side edge margins of the respective surround leg portions are moved to adjust their spacing. Fasteners 92,94, such as bolts, are inserted through the respective openings 84,86 and are coupled to the surround leg portion 20. Fasteners, such as screws 88,91, may be used to fix the bracket 90 to the mantel breast portion 24. The mantel leg portion 20 is slidable in directions 68 within the limits defined by the openings 84,86. After the spacing of the respective leg portions has been adjusted, fasteners 92,98 (e.g., nuts on bolts), may be tightened to establish the relative position between the surround leg portions 20,22 and the surround breast portion 24. Alternatively, the openings 84,86 may be positioned to overlay mantel breast portion 24 with fasteners 88,91 being used to fasten the lower portion of the bracket 90 to the surround leg portion 20. In this case, relative sliding motion of these components is still permitted.

Figure 10:
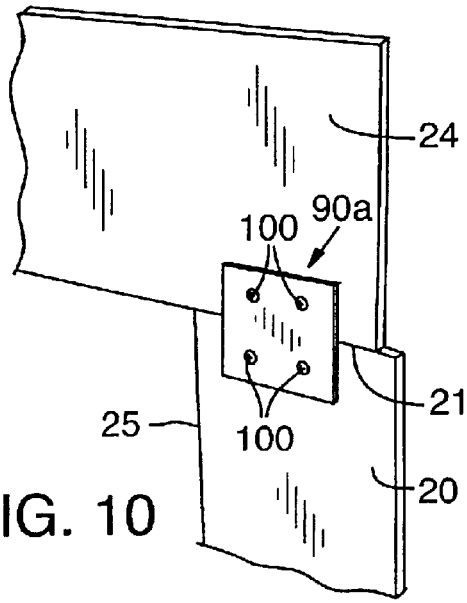
FIG. 10 is similar to FIG. 9 with an alternative form of coupling bracket.

FIG. 10 illustrates an alternative form of bracket 90*a* for coupling the surround leg portions to the surround breast portion. The FIG. 10 embodiment is less desirable as the bracket simply utilizes a plurality of fasteners, indicated at 100, such as screws for fastening the surround leg portions to the surround breast portion after the desired spacing has been established. FIG. 10*a* illustrates yet another form of bracket 90*b*. The bracket 90*b* has elongated openings 84,86 and fasteners 92,94 like those described above in connection with FIG. 9. In addition, similar elongated openings 84',86' and fasteners 92',94' are used to slidably couple the bracket 90B to the surround breast portion 24 to again accommodate the sliding motion in the direction indicated by arrows 68.

FIGS. 11–16 illustrate yet another embodiment of a fireplace assembly. In the embodiments of FIGS. 11–16, components which are like those described in previous embodiments have been assigned the same numbers.

With reference to FIG. 11, the fireplace 12 has a front with a built-in door or screen and lacks projections such as the flange 16 in the FIG. 1 embodiment. In this case, the surround may abut or be otherwise positioned along a front portion of the sides and top of the fireplace 12 when the assembly is completed. As shown in FIG. 11, the illustrated base 30 is of a plural section construction. In this case, base 30 is comprised of a rear base section 30*a* and a front base section 30*b*. This plural section construction is also shown in FIG. 12*a*. Section 30*a*, in this example, is generally comprised of a framework, which in the illustrated form, is rectangular although it may take other configurations. Base section 30*a* in the illustrated embodiment has a front piece 110, a rear piece 112, and first and second end pieces 114,116. Fastener receiving reinforcements, such as screw receiving blocks 58', may be positioned along the inside surfaces of end pieces 114,116. Fireplace supporting joists are typically positioned at spaced locations underneath the fireplace 12. A support member 118 having an upper fireplace supporting surface 120 is carried by the frame and supports the fireplace. A projecting lip portion 122 of member 118 may also be provided for use in interconnecting the base sections 30*a*,30*b*. Base section 30*b* may also be comprised of a frame, which may be rectangular or of some other desirable configuration (e.g., a curved face). This frame may be similar to the frame included in base sections 30*a* although it is typically narrower. Front and rear frame pieces 121,123 of this supporting frame are shown in FIG. 12*a*. A top member 125 may be carried by the frame of base section 30*b*. Trim pieces 124,126 and 128 may be respectively positioned along the side, front and side of section 30*b*. As shown in FIG. 12*a*, these trim pieces typically extend upwardly above surface 125 to accommodate tile or other decorative surfaces as explained below. In addition, the side trim pieces 124,126 may be set back from the rear edge of the top member 125 to accommodate additional baseboard or other trim components of a building structure or of the assembly.

A spacer, such as an elongated strip 130, is desirably mounted to the exposed surface of rear piece 123. As can be seen in FIG. 12A, spacer 130 is positioned underneath lip 122 with the adjacent edges of members 120,125 abutting one another when the illustrated form of base structure is assembled. Additional joist pieces, not shown, can be used to reinforce and support the member 125. In this particular embodiment, the spacer 130 establishes the depth of the respective slots 34,36. This can be seen from FIG. 12 where base section 30*b* is shown joined to base section 30*a*.

Figure 13:
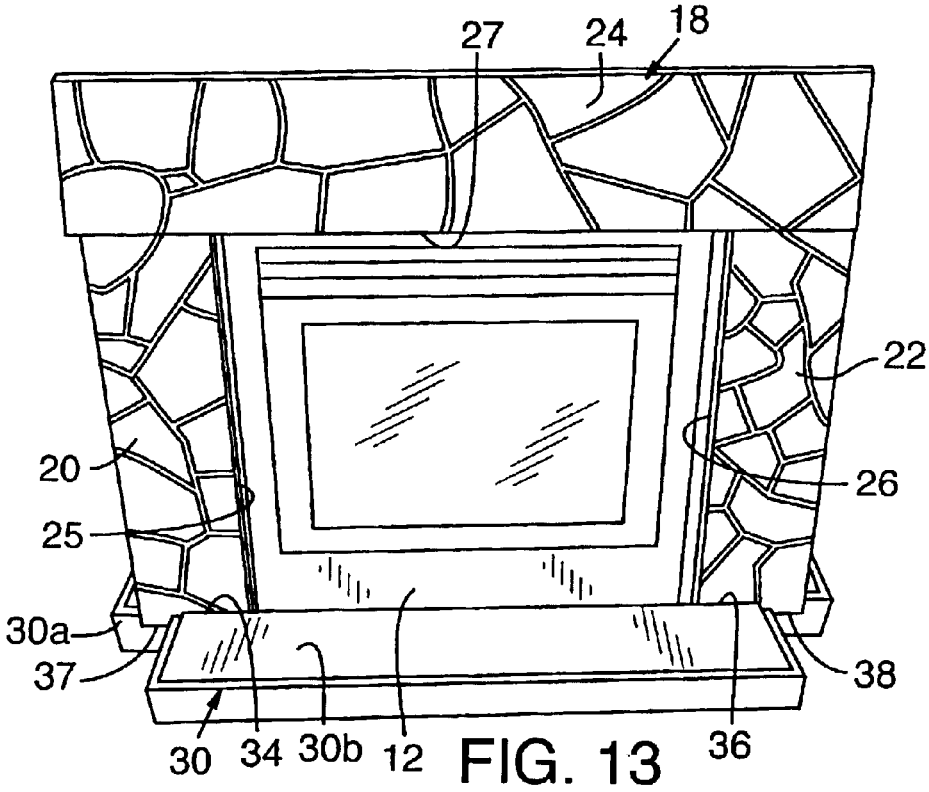
FIG. 13 illustrates the embodiment of FIG. 12 with a fireplace surround having lower surround leg end portions positioned in respective slots defined by the base sections.

FIG. 13 illustrates the surround 18 as it is moved into position. As can be seen in FIG. 13, the lower end portions 37,38 of respective surround leg portions 20,22 have been inserted downwardly into the respective slots 34,36. Although it is possible to saw or otherwise shorten the surround leg portions 20,22 before installation, typically this is unnecessary because the base 30 accommodates variations in the surround height depending upon the distance the leg end portions are inserted into the base. In this example, the lower edge 27 of surround breast portion 24 is resting along the top edge margin of fireplace 12, which limits the depth of insertion of the surround leg portions into the respective slots. In FIG. 13, the spacing between inner edges 25,26 of surround leg portions 20,26 have yet to be adjusted.

Figure 14:
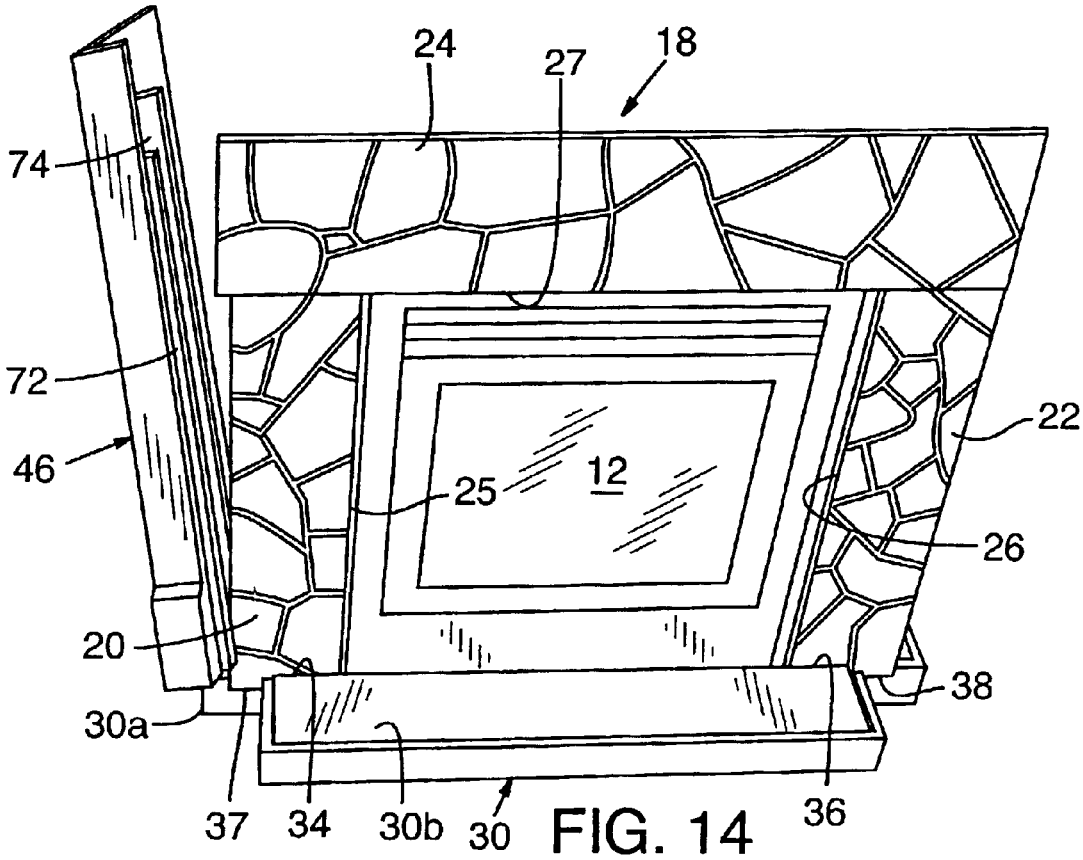
FIG. 14 illustrates a portion of the embodiment of FIG. 13 with the surround leg portion of this figure adjusted to approach the adjacent side of a fireplace and also showing a mantel side in the process of being installed.
Figure 15:
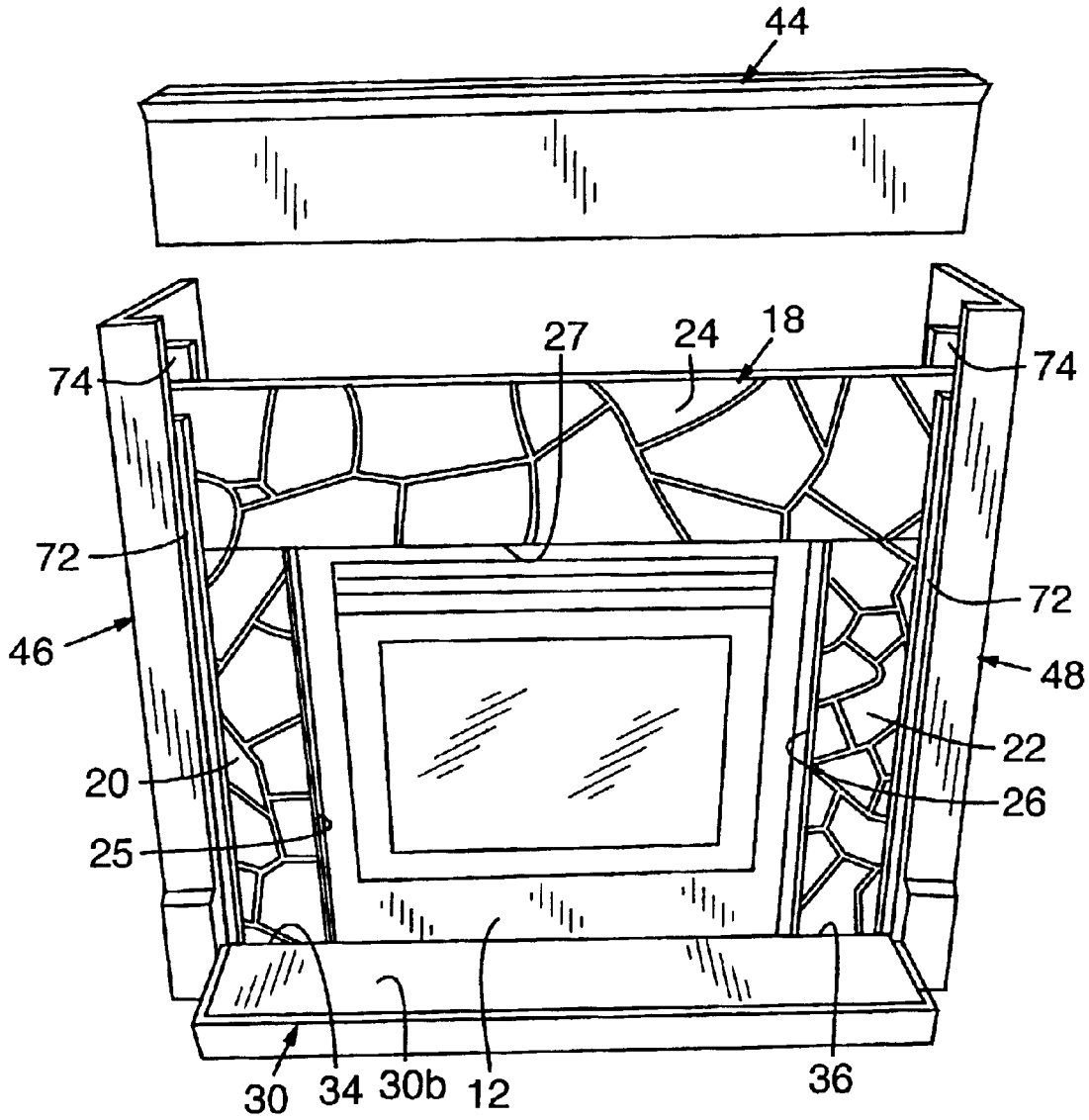
FIG. 15 illustrates the embodiment of FIG. 14 with a mantel breast portion shown being installed
Figure 16:
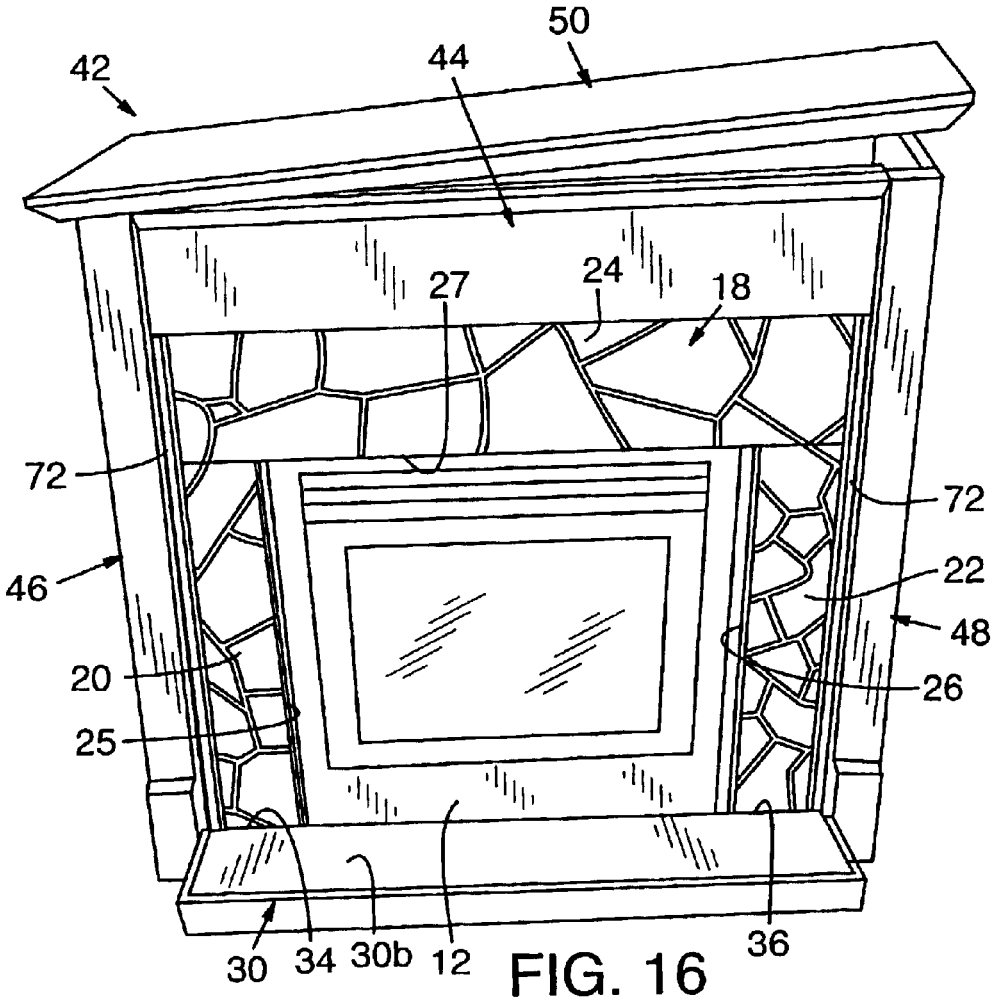
FIG. 16 illustrates the embodiment of FIG. 15 with a mantel shelf portion being installed.

FIG. 14 illustrates the assembly with surround leg portion 20 shifted to the right from the position shown in FIG. 13 to position inner edge 25 of surround leg portion 20 against or adjacent to the side edge margin of the fireplace 12. FIG. 14 also shows an illustrated exemplary mantel side 46 being moved into position with a slot in the mantel side receiving an outer upright edge margin of surround leg 20 and an end of mantel breast portion 24. Although less desirable, mantel sides may be used without mantel surround receiving slots. FIG. 15 illustrates the assembly with mantel breast portion 44 being moved into position. In addition, FIG. 16 illustrates the positioning of a mantel shelf 50 to complete the mantel assembly.

Figure 17:
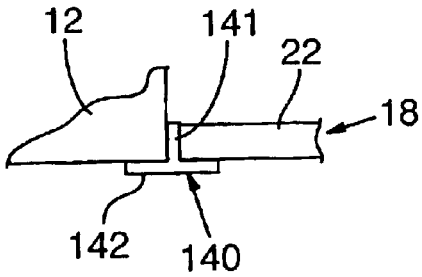
FIGS. 17–19 illustrate one form of trim structure which may be utilized to overlay a gap which may exist between the fireplace and surround.
Figure 18:
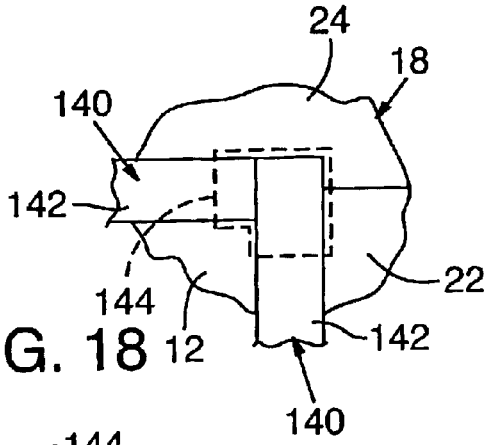
Figure 19:
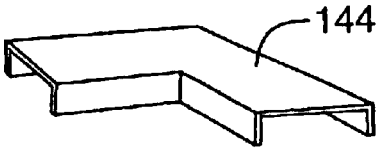

FIGS. 17–19 illustrate exemplary optional trim pieces 140 which may be used to overlay any gap that exists between the fireplace and mantel surround. As a specific example, the trim pieces may have a T-shaped configuration with a leg portion 141 positioned for insertion in a gap between fireplace 12 and the adjoining portion of the surround, such as surround leg portion 22 in FIG. 17. A cap portion 142 of trim piece 140 overlays adjoining side margins of the fireplace 12 and of the surround leg 22. Other alternative trim piece configurations may be used.

FIG. 18 illustrates a second similar trim piece 140 positioned to trim out the gap between the mantel surround breast portion 24 and the fireplace 12 along the top edge margin of the fireplace. An angular cap piece 144 is shown in dashed lines in FIG. 18 with a perspective view of this form of cap piece being shown in FIG. 19. Cap piece 144 may be used to cover the joint between the top trim piece and upright trim pieces at the respective corners of the illustrated fireplace and surround. These components may be secured in place in any convenient manner, such as using adhesive.

Figure 20:
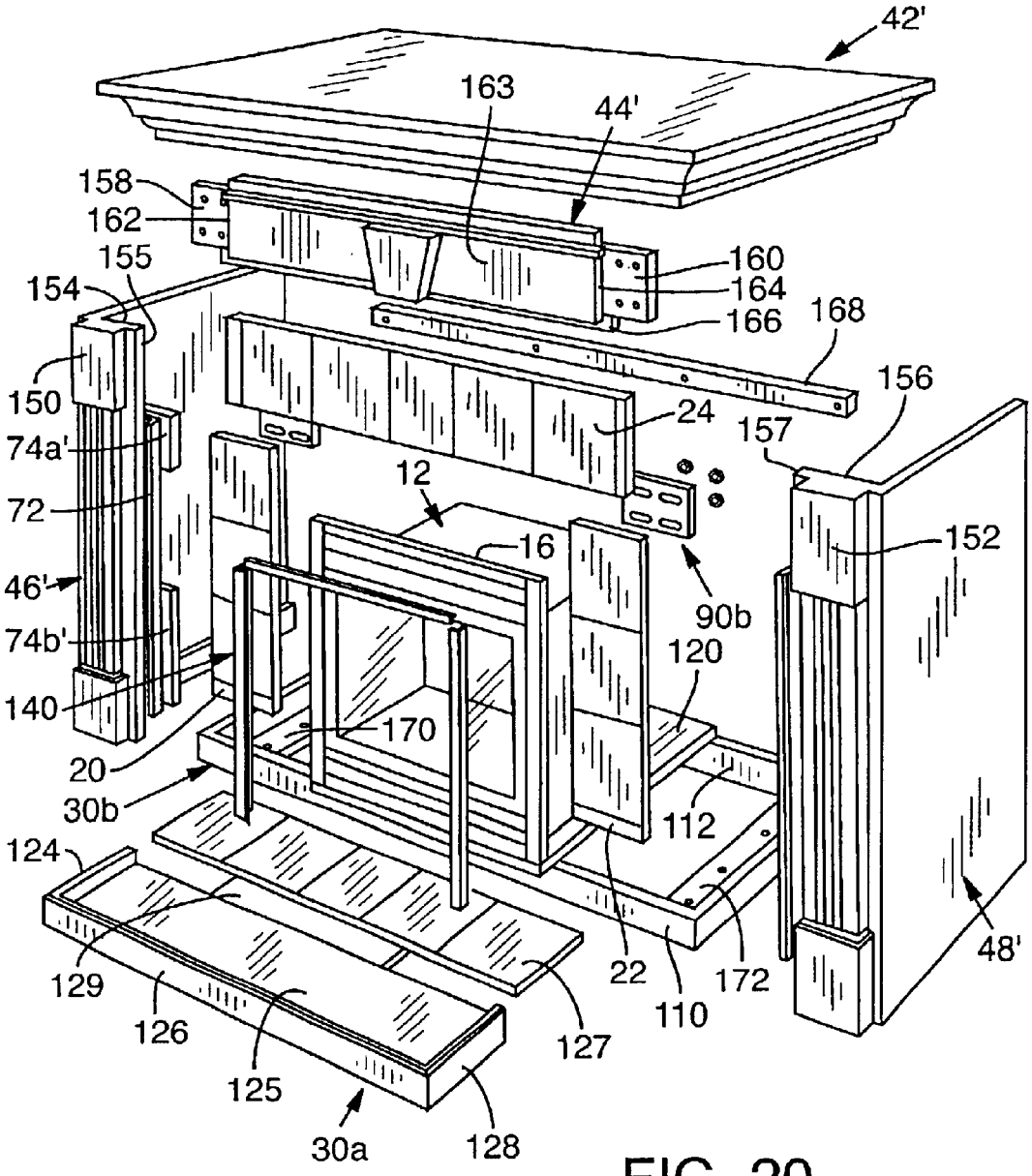
FIG. 20 is an exploded view of an alternative embodiment of a fireplace surround and mantel assembly.

FIG. 20 illustrates an exploded view of an alternative form of fireplace surround and mantel assembly to illustrate the fact that many variations are possible. In FIG. 20, components corresponding to those previously described have been given the same number and will not be described further. In some cases, the components have been assigned the same number with an "apostrophe" because the component has a different configuration from the corresponding component previously described and assigned the same number. These differences will be readily apparent and in general will not be discussed in detail.

In FIG. 20, the spacer 74 is shown as a plural piece component comprised of upper and lower spacer portions 74*a*' and 74*b*'. In addition, the top edge of spacer 74*a*' is shown in FIG. 20 as being at the same elevation as the top edge of mantel portion 72. In addition, the mantel breast portion 44' comprises a front portion 163 with respective side edges 162,164. In addition, the mantel breast portion 44' comprises connecting or support portions 158,160, which may be formed of a single elongated component which extends the full length of portion 163 and outwardly beyond the edges 162,164. In addition, the mantel breast portion 44' may comprise a back portion 166 positioned behind elements 158,160. In the illustrated form, back portion 166 extends outwardly beyond the edges 162,164 but ends short of the respective edges of elements 158,160. In the illustrated construction, the mantel side portion 46' includes a front piece 150 having a back surface 154 and an inner side edge 155. In addition, the mantel side portion 48' includes a front piece 152 having a back surface 156 and inner side edge 157. When the mantel is assembled, component 158 is secured, as by screws or other fasteners, and/or adhesive, to the surface 154. In addition, edge 162 abuts the edge 155. Similarly, component 160 is secured to surface 156 with edge 164 abutting the edge 157. Also, the lower surface of back portion 166 is typically set at an elevation such that when the lower surface is resting on the upper edge of spacers 74*a*', one spacer 74*a*' being associated with each mantel side portion. In addition, in this example, the upper edge surface of mantel breast portion 44' is at the same elevation as the upper edge surfaces of the mantel side portions 46' and 48'. Thus, spacers 74*a*', in this example, support the mantel breast portion 44' as it is being fastened to the mantel side portions. An elongated cleat 168 may be secured to the wall (typically anchored to studs in the wall) as shown in FIG. 20. The upper surface of cleat 168 is typically at the same elevation as the upper edges of mantel side portions 46' and 48'. Cleat 168 thus supports the mantel 42' when assembled. In addition, the respective outer ends of cleat 168 reinforce the rear upper corners of the mantel side portions 46' and 48' and maintain these corners at a desired spacing.

In the illustrated embodiment, anchoring portions 170, 172 are positioned at the respective ends of the base portion 30*b*. Components 170,172 have lower surfaces which are typically flush with the lower edges of base components 110,112. Thus, the lower surfaces of components 170,172 in the illustrated embodiment rest on the floor when the base 30*b* is positioned. Fasteners may be used to anchor components 170,172 to the floor of the room in which the fireplace is being installed and thereby to secure the base 30*b* in position.

In the construction shown, the tile or other decorative finish which is installed on the surface 125 of base portion 30*a* may be of an elongated construction such as indicated at 127 in FIG. 20. Decorative piece 127 may be slid onto the surface 125 and secured in place. For rigidifying and support purposes, component 127 may have a support portion 129 which is positioned beneath the support portion of base 30(*a*) that includes surface 125.

Having illustrated and described the principles of our invention with respect to several embodiments, it should be apparent to those of ordinary skill in the art that the invention may be modified in arrangement and detail without departing from its principles. We claim as our invention all such modifications which fall within the spirit and scope of the following claims.

We claim:

1. A fireplace installation assembly comprising:

a base comprising an upper surface and a back surface;

the base defining at least one surround receiving opening extending below the upper surface, wherein the at least one opening has a back boundary, the back boundary being spaced from the back surface by a portion of the base positioned between at least a portion of the back boundary and the back surface;

a fireplace surround comprising first and second surround leg portions and a surround top portion; and the first and second surround leg portions comprising respective first and second lower surround leg end portions which are inserted into said at least one opening with the extent of insertion of the respective first and second surround leg end portions into the surround receiving opening adjusting the height of the fireplace surround.

2. A fireplace assembly according to claim 1, wherein the base comprises a front edge portion and wherein the at least one opening comprises an elongated opening extending parallel to the front edge portion.

3. A fireplace installation assembly according to claim 1 in which the at least one opening comprises first and second elongated surround leg portion receiving slots defined by the base and entirely surrounded by portions of the base, the first slot being positioned to receive the first lower surround leg end portion and the second slot being positioned to receive the second lower surround leg end portion.

4. A fireplace opening according to claim 3 for a fireplace having a front and wherein the base has a width dimension which extends in a direction which is parallel to the fireplace front, and wherein the first and second slots extend lengthwise in the width direction.

5. A fireplace installation assembly according to claim 1 wherein the base comprises a front base portion and a rear base portion which are interconnected to form the base.

6. A fireplace installation assembly according to claim 5 wherein the at least one opening has a front boundary and wherein at least a portion of the front boundary of the at least one opening is defined by the front base portion and wherein at least a portion of the back boundary of the at least one opening is defined by the rear base portion.

7. A fireplace assembly according to claim 6 wherein the base comprises first and second spaced apart sides, the base having a width dimension in a direction extending from the first side toward the second side, wherein the front and rear base portions are joined together along a joint that is spaced from the back surface of the base, the at least one opening comprising first and second spaced apart elongated surround leg receiving slots extending in the width direction and positioned adjacent to the joint, the first surround leg receiving slot being positioned to receive the first lower surround leg end portion and the second surround leg receiving slot being positioned to receive the second lower surround leg end portion.

8. A fireplace installation assembly according to claim 7 for a fireplace having a fireplace projection extending outwardly from at least an upper portion of the fireplace, the top surround portion comprising an insertion limiter adapted for coupling to the fireplace projection to limit the insertion of the first and second lower surround leg end portions into the respective first and second surround leg receiving slots.

9. A fireplace installation assembly comprising:

a base comprising an upper surface;

the base defining at least one surround receiving opening extending below the upper surface;

a fireplace surround comprising first and second surround leg portions and a surround top portion;

the first and second surround leg portions comprising respective first and second lower surround leg end portions which are inserted into said at least one opening with the extent of insertion of the respective first and second surround leg end portions into the surround receiving opening adjusting the height of the fireplace surround; and wherein the top surround portion comprises an insertion limiter adapted for coupling to a fireplace projection to limit the insertion of the first and second lower surround leg end portions into the at least one surround receiving opening.

10. A fireplace installation assembly according to claim 9 wherein the first surround leg portion is adapted for coupling to a first fireplace projection portion, wherein the second surround portion is adapted for coupling to a second side fireplace projection portion, and wherein the insertion limiter is adapted for coupling to a top fireplace projection portion.

11. A fireplace installation assembly according to claim 10 wherein the surround top portion comprises a lower edge portion and wherein the insertion limiter comprises the top surround portion lower edge portion.

12. A fireplace installation assembly of claim 10 for a fireplace having a fireplace opening with sides and a top and wherein the first, second and top fireplace projection portions comprise a continuous flange extending outwardly and adjacent to the sides and top of the fireplace opening.

13. A fireplace installation assembly comprising:

a base comprising an upper surface;

the base defining at least one surround receiving opening extending below the upper surface;

a fireplace surround comprising first and second surround leg portions and a surround top portion;

the first and second surround leg portions comprising respective first and second lower surround leg end portions which are inserted into said at least one opening with the extent of insertion of the respective first and second surround leg end portions into the surround receiving opening adjusting the height of the fireplace surround; and in which the first and second surround leg portions are movable relative to the surround top portion so as to adjust the spacing of the first surround leg portion from the second surround leg portion.

14. A fireplace installation assembly comprising:

a base comprising an upper surface;

the base defining at least one surround receiving opening extending below the upper surface;

a fireplace surround comprising first and second surround leg portions and a surround top portion;

the first and second surround leg portions comprising respective first and second lower surround leg end portions which are inserted into said at least one opening with the extent of insertion of the respective first and second surround leg end portions into the surround receiving opening adjusting the height of the fireplace surround; and wherein the first and second surround leg portions are slidably coupled to the surround top portion for sliding movement relative to the surround top portion so as to adjust the spacing of the first surround leg portion from the second surround leg portion.

15. A fireplace installation assembly comprising:

a base comprising an upper surface;

the base defining at least one surround receiving opening extending below the upper surface;

a fireplace surround comprising first and second surround leg portions and a surround top portion;

the first and second surround leg portions comprising respective first and second lower surround leg end portions which are inserted into said at least one opening with the extent of insertion of the respective first and second surround leg end portions into the surround receiving opening adjusting the height of the fireplace surround; and wherein each of the first and second surround leg portions comprises an outer surround leg upright edge portion and an inner surround leg upright edge portion, the respective inner surround leg upright edge portions being adapted for positioning along respective sides of a fireplace opening, the top surround portion comprising an upper top surround edge portion and a lower top surround edge portion, the lower top surround edge portion being adapted for positioning along at least a portion of a top of a fireplace opening, the fireplace installation assembly further comprising a mantel assembly, the mantel assembly comprising a first mantel side portion have an upright surround leg receiving slot positioned to receive the outer surround leg upright edge portion of the first surround leg portion, a second mantel side portion having an upright surround leg receiving slot positioned to received the outer surround leg upright edge portion of the second surround leg portion, a mantel breast portion coupling the first mantel side portion to the second mantel side portion, the mantel breast portion comprising a lower mantel breast edge portion positioned to cover a portion of the upper top surround edge portion, and the mantel assembly further comprising a mantel shelf coupled to the first and second mantel side portions and to the mantel breast portion.

16. A fireplace installation assembly for supporting a fireplace in a room having a floor, the assembly comprising:

a base for positioning onto the floor, the base comprising an upper fireplace supporting surface spaced above the floor;

a fireplace surround comprising first and second surround leg portions and a surround top portion;

the base comprising first an second elongated surround leg portion receiving slots, the first slot being positioned to receive the first surround leg portion and the second slot being positioned to receive the second surround leg portion, whereby the height of the fireplace surround is established by adjusting the extent of downward insertion of the first and second surround leg portions into the respective first and second slots;

the first and second surround leg portions being movable relative to the surround top portion to thereby adjust the spacing between the first and second surround leg portions; and a mantel assembly comprising a first mantel side portion coupled to the first surround leg portion, a second mantel side portion coupled to the second surround leg portion, a mantel breast portion extending from the first mantel side portion to the second mantel side portion, the mantel breast portion comprising a lower portion positioned to cover a portion of the top surround portion, and the mantel assembly further comprising a mantel shelf.

17. A fireplace installation assembly according to claim 16 wherein each of the first and second surround leg portions has an outer edge portion, the first mantel side portion comprising a first channel positioned to receive at least a portion of the outer edge portion of the first leg surround portion and the second mantel side portion comprising a second channel positioned to receive at least a portion of the outer edge portion of the second leg surround portion.

18. A fireplace installation assembly according to claim 16 wherein the base comprises first and second base portions and wherein at least a portion of the first and second slots is defined by the first base portion and at least a portion of the first and second slots is defined by the second base portion.

19. A fireplace opening according to claim 16, for a fireplace having a front and wherein the base as a with dimension in a direction which is parallel to the fireplace front, and wherein the first and second slots extend lengthwise in the width direction.

20. A fireplace installation assembly according to claim 16, for a fireplace having a fireplace projection extending outwardly from at least an upper portion of the fireplace, the top surround portion comprising an insertion limiter adapted for coupling to the fireplace projection to limit the insertion of the first and second surround leg portions into the respective first and second slots.

21. A fireplace installation assembly for a fireplace comprising:

a base;

the base defining at least one opening, wherein the at least one opening has a front, a rear and sides, and wherein the front, the rear and at least one side of the opening are each bounded at least in part by a portion of the base;

a fireplace surround comprising first and second surround leg portions; and the first and second surround leg portions being at least partially inserted into said at least one opening with the extent of insertion of the respective surround leg portions into the opening adjusting the height of the fireplace surround.

22. A fireplace installation assembly comprising:

a base;

the base defining at least one opening;

a fireplace surround comprising first and second surround leg portions;

the first and second surround leg portions being at least partially inserted into said at least one opening with the extent of insertion of the respective surround leg portions into the opening adjusting the height of the fireplace surround; and the top surround portion comprising an insertion limiter adapted for coupling to a fireplace projection to limit the insertion of the first and second surround leg portions into the at least one opening.

23. A fireplace installation assembly according to claim 21 wherein said at least one opening comprises a plurality of spaced apart openings and wherein the front, the rear and at least one side of each opening are bounded at least in part by a portion of the base.

24. A fireplace installation assembly comprising:

a base;

the base defining at least one opening;

a fireplace surround comprising first and second surround leg portions;

the first and second surround leg portions being at least partially inserted into said at least one opening with the extent of insertion of the respective surround leg portions into the opening adjusting the height of the fireplace surround; and wherein the surround comprises a surround top portion and wherein the first and second surround leg portions are slidably coupled to the surround top portion.

25. A fireplace installation assembly for supporting a fireplace having a fireplace front, a fireplace opening and a fireplace projection extending outwardly from the fireplace front, the assembly comprising:

a base comprising an upper fireplace supporting surface;

the base defining at least one opening extending below the fireplace supporting surface;

a fireplace surround comprising first and second surround leg portions and a surround top portion;

the first and second surround leg portions being inserted downwardly into said at least one opening with the extent of downward insertion of the respective surround leg portions adjusting the height of the fireplace surround;

the at least one opening comprising first and second elongated surround leg portion receiving slots defined by the base, the first slot being positioned to receive the first surround leg portion and the second slot being positioned to receive the second surround leg portion;

the base having a width dimension in a direction which is parallel to the fireplace front, and wherein the slots extend lengthwise in the width direction;

the top surround portion comprising an insertion limiter adapted for coupling to the fireplace projection to limit the insertion of the first and second surround leg portions into the at least one opening;

wherein the first and second surround leg portions are slidably coupled to the surround top portion; and each of the first and second surround leg portions comprising an outer surround upright edge portion and an inner surround upright edge portion, the inner surround upright edge portions of the first and second surround leg portions being spaced apart from one another and being positioned along the respective sides of the fireplace opening, the top surround portion comprising an upper edge portion and a lower edge portion, the lower edge portion being positioned along at least a portion of the top of the fireplace, the fireplace installation assembly further comprising a mantel assembly, the mantel assembly comprising a first mantel side portion comprising an upright surround leg receiving slot positioned to receive at least a portion of the outer surround upright edge portion of the first surround leg portion, a second mantel side portion comprising an upright surround leg receiving slot positioned to receive at least a portion of the outer surround edge portion o the second surround leg portion, a mantel breast portion coupling the first mantel side portion to the second mantel side portion, the mantel breast portion comprising a lower edge portion positioned to cover a portion of the upper edge portion of the top surround portion, and the mantel assembly further comprising a mantel shelf coupled to the first and second mantel sides and to the breast portion.

26. A fireplace installation assembly according to claim 25 wherein the base comprises plural base sections and wherein a portion of each of the first and second slots is defined by one of the plural base sections and a portion of each of the first and second slots is defined by another of the base sections.

27. A fireplace installation assembly for supporting a fireplace comprising:

a base;

a fireplace surround comprising first and second surround leg portions and a top portion, the surround leg portions each have a lower end portion;

the base comprising means for receiving the lower end portions of the respective leg portions to adjust the height of the fireplace surround, the means for receiving comprising means surrounding more than one-half of each of the leg portions the means for receiving further comprising at least one opening having a back boundary, the back boundary being spaced from a back surface of the base by a portion of the base positioned between at least a portion of the back boundary and the back surface.

28. A fireplace installation assembly according to claim 27 comprising means for adjusting the spacing between the first and second surround leg portions.

29. A fireplace installation assembly according to claim 28, comprising mantel means for positioning along the sides and top of the fireplace surround.

30. A method of installing a fireplace assembly comprising:

placing a base onto a floor of a room;

placing a fireplace onto an upper surface of the base;

adjusting the spacing between first and second surround leg portions of a fireplace surround to position the respective leg portions adjacent to the respective sides of a fireplace opening; and positioning lower end portions of the respective first and second surround leg portions below the upper surface of the base to position a lower edge portion of a surround top piece at a desired elevation relative to the floor of the room, the elevation being determined by the extent to which the lower end portions of the respective first and second surround leg portions are positioned below the upper base surface.

31. A method according to claim 30, in which the acts take place in the order set forth in claim 30.

32. A method according to claim 30, in which the act of adjusting the spacing is accomplished prior to the act of positioning the lower end portions.

33. A method according to claim 30 in which the act of adjusting the spacing is accomplished after the act of positioning the lower end portions.

34. A method according to claim 30, wherein the act of positioning the lower end portions comprises inserting the lower end portions into at least one opening defined by the base.

35. A method according to claim 30, further comprising the acts of:

positioning a first mantel side so as to place at least a portion of an outer side edge of the first leg surround portion into a side slot of the first mantel side;

positioning a second mantel side so as to place at least a portion of an outer side edge of the second leg surround portion into a side slot of the second mantel side;

positioning a mantel breast portion so as to extend at least from the first mantel side to the second mantel side; and coupling a mantel shelf to the first and second mantel sides and to the mantel breast portion.

36. A method according to claim 35, wherein the act of placing a base comprise the act of placing a base comprising at least first and second base portions with a portion of the at least one opening being defined by the first base portion and a portion of the at least one opening being defined by the second base portion.

* * * * *

UNITED STATES PATENT AND TRADEMARK OFFICE

CERTIFICATE OF CORRECTION

PATENT NO. : 6,796,088 B2
DATED : September 28, 2004
INVENTOR(S) : Richmond et al.

It is certified that error appears in the above-identified patent and that said Letters Patent is hereby corrected as shown below:

Column 14,
Line 5, “as” should be -- has --; and “with” should be -- width --.

Signed and Sealed this

Fourth Day of April, 2006

JON W. DUDAS
*Director of the United States Patent and Trademark Office*